US005141484A

United States Patent [19]

Akira

[11] Patent Number: 5,141,484

[45] Date of Patent: Aug. 25, 1992

[54] SHEET CURLS REFORMER

[75] Inventor: Sakurabayashi Akira, Shizuoka, Japan

[73] Assignee: Kobayashi Engineering Works, Ltd., Shizuoka, Japan

[21] Appl. No.: 824,895

[22] Filed: Jan. 21, 1992

Related U.S. Application Data

[63] Continuation of Ser. No. 642,694, Jan. 14, 1991, abandoned, which is a continuation of Ser. No. 348,067, May 5, 1989, abandoned.

[30] Foreign Application Priority Data

May 10, 1988 [JP] Japan ..... 63-111656

[51] Int. Cl.[5] ..... B31F 7/00

[52] U.S. Cl. ..... 493/8; 162/270; 162/271; 493/459

[58] Field of Search ..... 162/270, 271; 493/406, 493/416, 442, 8, 23, 459

[56] References Cited

U.S. PATENT DOCUMENTS

| | | | |
|---|---|---|---|
| 2,658,432 | 11/1953 | Baumgartner | 162/271 |
| 2,918,897 | 12/1959 | Zernov | 162/271 |
| 3,546,067 | 12/1970 | Heidepriem | 162/271 |
| 3,661,703 | 5/1972 | Shelor | 162/271 |
| 3,779,138 | 12/1973 | Lindstaedt | 493/461 |

*Primary Examiner*—Bruce M. Kisliuk
*Assistant Examiner*—Jack Lavinder
*Attorney, Agent, or Firm*—Koda and Androlia

[57] ABSTRACT

The apparatus for straightening sheet curls of the present invention is operating in the following processes (1) and (2) when splicing the sheets from the parent rolls:

(1) The wrap angle adjusting apparatus starts to return one of the main backup rolls and the decurler bar from the position corresponding to the small parent roll to the position corresponding to the large parent roll.

(2) The apparatus for suddenly changing the wrap angle causes the other of the main backup rolls and the decurler bar to retract from the standard position at which the sheet is pushed inwardly to a position at which the sheet is not pushed inwardly or moderately so as to suddenly change the wrap angle of the sheet substantially at the same timing as the start of return above described in process (1). During this operation, the sheet is guided by the secondary backup rolls, and the wrap angle of the sheet is set to a value appropriate to the diameter of the second parent roll having a large diameter. As a result, the curls in the sheet wound off from the second parent roll having a large diameter are appropriately straightened (refer to FIG. 4(B)).

1 Claim, 4 Drawing Sheets

SHEET CURLS REFORMER

This is a continuation of application Ser. No. 642,694, filed Jan. 14, 1991, now abandoned which is a continuation of application Ser. No. 348,067, filed May 5, 1989 now abandoned.

FIELD OF THE INVENTION

The present invention relates to an apparatus for straightening curls in a sheet made of a plastic film, paper, a metallic foil or the like which is wound off from a raw material roll.

DESCRIPTION OF THE PRIOR ART

Background of the Invention

For example, in an apparatus for cutting and treating a sheet, the sheet wound off from a parent roll is cut into given lengths by a cutting machine. At this time, if the sheet wound off from the parent roll is cut in that state, curls come into the open in the cut sheets. Such curls create problems such as jamming which may occur in a line for cutting and treating the sheets and in the sheet inlet portion of a printing machine or of various other machines when the sheets are thereafter introduced therein.

An apparatus for straightening curls in a sheet has previously been proposed in which a wrap angle is provided for a sheet wound off from a parent roll by applying a decurler bar to the sheet between two backup rolls, as described in Japanese Patent Publication No. 48427/1985.

The degree to which curls are straightened by the above-described apparatus for straightening sheet curls depends upon the wrap angle of the sheet, and the greater the wrap angle is, the stronger the pressure with which the sheet is wiped with the decurler bar and the greater the degree to which curls are straightened.

On the other hand, when a sheet is wound off from a parent roll, the extent to which curls are present in the sheet increases as the diameter of the parent roll decreases while winding-off progresses.

The use of the above-described apparatus for straightening sheet curls therefore requires monitoring of the change in the diameter of the parent roll and the provision of a wrap angle adjusting device which is capable of adjusting the relative position between the backup rolls and the decurler bar in such a manner that the wrap angle of the sheet is increased as the diameter of the parent roll decreases.

For example, such a wrap angle adjusting device is so configured that the decurler bar is displaced from a position corresponding to a large parent roll (the position where a low degree of pushing force is applied inwardly) to a position corresponding to a small parent roll (the position where a high degree of pushing force is applied inwardly) in the state wherein the backup rolls are set at standard positions with the sheet pushed in.

For example, a sheet cutting and treating apparatus which is provided with an apparatus for straightening sheet curls is also provided with a sheet splicing apparatus for the purpose of continuously operating the line. In this sheet splicing apparatus, the portion at the rear end of the sheet supplied from a first parent roll is spliced to the portion at the front end of the sheet supplied from a second parent roll in the stage where the sheet is completely wound off from the first parent roll, whereby the sheet spliced can be continuously supplied to the line.

The use of the sheet splicing apparatus therefore causes the diameter of the parent roll from which the sheet is wound off to be changed from a minimum diameter (the final diameter of the first parent roll) to a maximum diameter (the initial diameter of the second parent roll) in a moment. It is therefore necessary that the position of the decurler bar in an apparatus for straightening sheet curls which is provided in succession to the sheet splicing apparatus he changed in an instant from the position corresponding to a small parent roll to the position corresponding to a large parent roll by the wrap angle adjusting device in correspondence with the sudden change in diameter of the parent rolls.

The wrap angle adjusting device, however, has a limited level of mechanical sensitivity and thus great difficulty in changing in an instant the position at which the decurler bar is set in the manner described above. In other words, the displacement of the decurler bar from the position corresponding to the large parent roll to the position corresponding to the small parent roll in the direction the decurler bar is pushed inwardly requires a highly precise resolving power. In the case of use of the wrap angle adjusting device, for example, of a screw type, even if the displacement of the decurler bar is performed at a high speed of 0.5 second/cm to 2 seconds/cm in the direction of return from the position corresponding to the small parent roll to the position corresponding to the large parent roll, the time required for the return is as long as 3 to 10 seconds. On the other hand, the cutting machine provided on the outlet side of the sheet curl straightening apparatus has a cutting ability of 5 cut/second to 10 cut/second.

(1) Conventional apparatus for straightening sheet curls produce a large degree of breakage owing to poor curls which are produced by a poor wrap angle during the time the decurler bar is displaced to the position corresponding to the large parent roll because the setting position of the decurler bar cannot be changed in an instant if the line speed is kept at a high value which is determined by, for example, the cutting ability of a cutting machine, or produce jamming owing to a sudden change in the state of the high-speed operation of the line, leading to an impossibility of operation of the line. (2) Although the above-described jamming can be avoided by reducing the line speed to a low value at the sacrifice of a large degree of productivity during the time the decurler bar is displaced to the position corresponding to the large parent roll, the occurence of poor curls owing to a poor wrap angle cannot be avoided.

It is an object of the present invention to straighten curls in a sheet in a certain and appropriate manner while maintaining the productivity of a line during the time a first parent roll is changed into a second parent roll.

DISCLOSURE OF THE INVENTION

The present invention provides an apparatus for straightening sheet curls which is provided in succession to a sheet splicing apparatus for splicing the portion at the rear end of a sheet supplied from a first parent roll to the portion at the front end of a sheet supplied from a second parent roll and in which a wrap angle is provided for a sheet wound off from each parent roll by applying a decurler bar between two main backup rolls to the sheet for the purpose of straightening curls in the sheet, the apparatus being characterized by comprising (a) a wrap angle adjusting device for adjusting the wrap angle of the sheet by relatively displacing one of the main backup rolls and the decurler bar from a position corresponding to a large parent roll to a position corresponding to a small parent roll in correspondence with the change in diameter of the parent roll in the state wherein the other is set to the standard position at which the sheet is pushed inwardly, and for returning one of the main backup rolls and the decurler bar to the position corresponding to the large parent roll from the small parent roll when the sheets respectively supplied fromthe first and second parent rolls are spliced to each other by the sheet splicing apparatus; (b) and apparatus for suddenly changing the wrap angle by retracting the other of the main backup rolls and the decurler bar from the standard position at which the sheet is pushed inwards to a position that the sheet is not pushed inwardly or moderately pushed inwardly substantially at the same timing as the return of the one of the main backup rolls and the decurler bar from the position corresponding to the small parent roll to the position corresponding to the large parent roll is started by the wrap angle adjusting device; and (c) secondary backup rolls which are provided on both sides of the main backup rolls and which serve to guide the sheet in such a manner that the wrap angle of the sheet is a value appropriate to the diameter of the second parent roll having a large diameter when the other of the main backup rolls and the decurler bar is retracted from the standard position at which time the sheet is pushed inwardly by the apparatus for suddenly changing said wrap angle.

The operation of the apparatus for straightening sheet curls of the present invention is as follows:

(A) When the sheet is wound off from the same parent roll, the wrap angle adjusting device functions to displace one of the main backup rolls and the decurler bar from the position corresponding to the large parent roll to the position corresponding to the small parent roll in correspondence with the change in diameter of the parent roll used in the state wherein the other of the main backup rolls and the decurler bar is set at the standard position at which the sheet is pushed inwardly. The wrap angle of the sheet is therefore set to an appropriate value for the diameter of the relevant parent roll, resulting in appropriate straightening of curls (refer to FIG. 4(A)).

(B) When the sheets from the first and second parent rolls are spliced to each other by the sheet splicing apparatus, the wrap angle adjusting device functions in the following processes (1) to (4):

(1) The wrap angle adjusting device starts to return one of the main backup rolls and the decurler bar from the position corresponding to the small perent roll to the position corresponding to the large parent roll.

(2) The apparatus for suddenly changing the wrap angle causes the other of the main backup rolls and the decurler bar to retract from the standard position at which the sheet is pushed inwardly to a position at which the sheet is not pushed inwardly or moderately so as to suddenly change the wrap angle of the sheet substantially at the same time as the start of return above described in process (1). During this operation, the sheet is guided by the secondary backup rolls, and the wrap angle of the sheet is set to a value appropriate to the diameter of the second parent roll having a large diameter in a moment. As a result, the curls in the sheet wound off from the second parent roll having a large diameter are appropriately straightened (refer to FIG. 4(B)).

(3) One of the main backup rolls and the decurler bar is completely returned to the position corresponding to the large parent roll by the wrap angle adjusting device (refer to FIG. 4(C)).

(4) The other of the main backup rolls and the decurler bar is reset to the position at which the sheet is pushed inwardly from the position described in process (2) in which the other is retracted, by the apparatus for suddenly changing the wrap angle (refer to FIG. 4(D)).

(C) One of the main backup rolls and the decurler bar is displaced from the position corresponding to the large parent roll to the position corresponding to the small parent roll in correspondence with the change in diameter of the second parent roll in the same manner as that above described in (A), resulting in appropriate straightening of curls (refer to FIGS. 4(E), 4(F)).

The present invention therefore enables the wrap angle of the sheet to be changed in an instant in accordance with the rapid change in diameter of the parent rolls in the state wherein the line speed is kept at a high value which is determined by, for example, the cutting capacity of the cutting machine, when the first and second parent rolls are changed over in the manner above described in (B). The curls in the sheet can be appropriately and precisely straightened, while the productivity of the line being maintained.

DETAILED DESCRIPTION OF THE PREFERRED EMBODIMENTS

Figure 1:
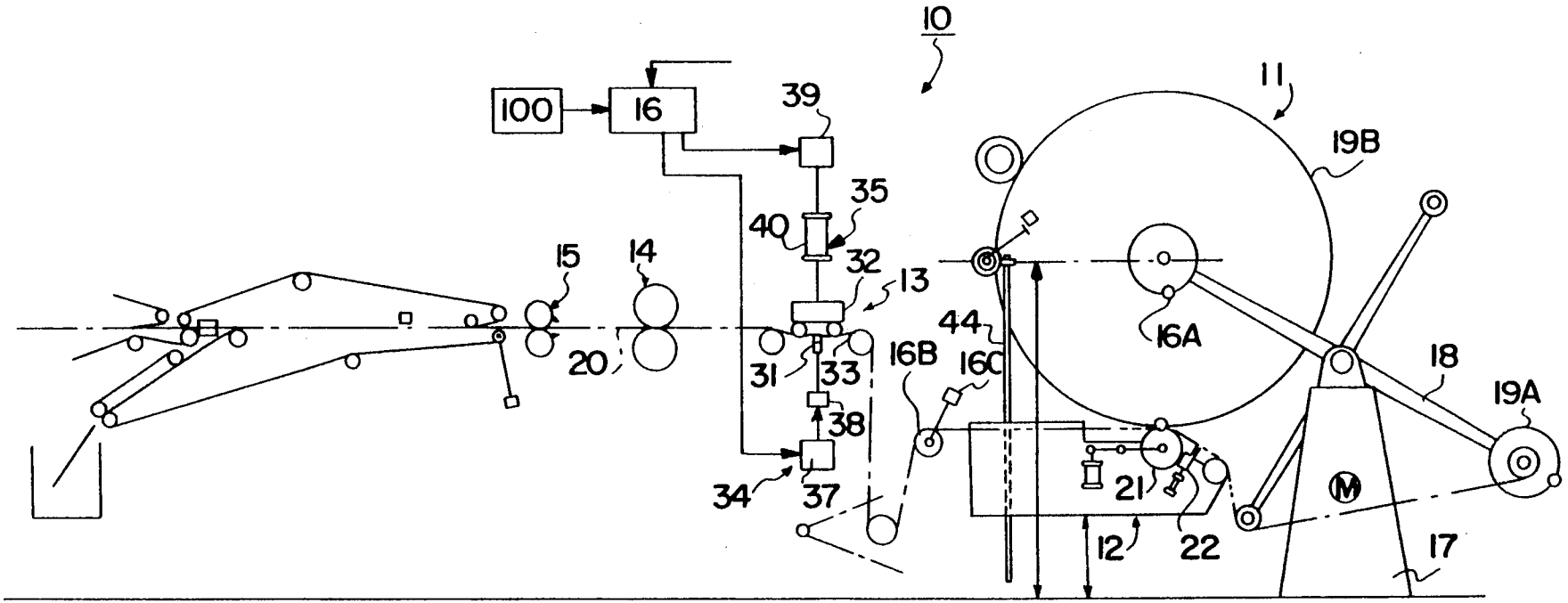
FIG. 1 is a schematic diagram of an example of a sheet cutting and treating apparatus to which the present invention is applied.

A sheet cutting and treating apparatus 10 comprises a sheet feeder 11, a sheet splicing apparatus 12, a curl straightening apparatus 13, a feed roll 14, a cutting machine 15, and a controller 16.

The sheet feeder 11 has a turning arm 18 which is supported by a frame 17 and which has both ends respectively supporting parent rolls 19 (a first parent roll 19A and a second parent roll 19B) to supply a sheet 20 from each of the parent rolls 19.

The sheet splicing apparatus 12 comprises a pressure roller 21 and a knife 22, (1) the pressure roller 21 functioning to press the portion at the rear end of the sheet supplied from the first parent roll 19A against the adhesive double coated tape which was applied to the portion at the front end of the sheet supplied from the second parent roll 19B, and (2) the knife 22 functioning to cut off the sheet supplied from the first parent roll 19A at the rear end thereof which is adjacent to the splicing portion.

The curl straightening apparatus 13 serves to straighten curls produced in the sheet 20 in correspondence with the change in the diameter D of each of the parent rolls 19, as described below.

The feed roll 14 functions to provide the sheet 20 with a tension required for winding out the sheet 20 from each of the parent rolls 19.

The cutting machine 15 functions to cut the sheet 20 which is straightened while being continuously carried in the curl straightening apparatus 13 into an appropriate length.

The controller 16 functions to control each of the sheet feeder 11, the sheet splicing apparatus 12, the curl straightening apparatus 13, the feed roll 14 and the cutting machine 15.

The controller 16 is able to count the rotational speed N1 of the first parent roll 19A using a parent roll rotation detector 16A provided on the turning arm 18 in order to observe any change of the diameter D of the first parent roll 19A, as well as counting the rotational speed N2 of an intermediate roll 16B (having a known diameter E) using a rotation detector 16C provided for the intermediate roll 16B. The controller 16 is also able to always perform a calculation of $D=E(N2/N1)$ in CPU using the relationship: sheet speed $V=\pi DN1=\pi EN2$, to obtain the diameter D of the first parent roll 19A.

When the diameter D of the first parent roll 19A is reduced to a diameter F which is preparatory to exchange, the controller 16 causes the turning arm 18 of the sheet feeder 11 to be turned so as to place the first parent roll 19A at the position shown in FIG. 1 at which the work of splicing is effected, and then drives the sheet splicing apparatus 12 which thus performs the splicing of the sheets respectively supplied from the first parent roll 19A and the second parent roll 19B in the manner described above.

A description will now be given of a typical configuration of the curl straightening apparatus 13.

The curl straightening apparatus 13 comprises a decurler bar 31, two main backup rolls 32 which are provided on both sides of the decurler bar 31, two secondary backup rolls 33 which are provided on both outer sides of each of the main backup rolls 32, a wrap angle adjusting device 34 for driving the decurler bar 31, and an apparatus 35 for suddenly changing the wrap angle which serves to drive the main backup rolls 32.

In other words, the curl straightening apparatus 13 serves to straighten curls produced in the sheet 20 by applying the decurler bar 31 to the sheet 20 wound out from each of the parent rolls 19 between the two main backup rolls 32 so as to provide a wrap angle $\theta$ for the sheet 20.

(a) The wrap angle adjusting device 34 drives the decurler bar 31 using, for example, a screw-type feeder 38 which is operated by a driving portion 37 controlled by the controller 16. The decurler bar 31 is longitudinally displaced along the prependicular bisector of the line connecting the right and left main backup rolls 32.

Figure 2:
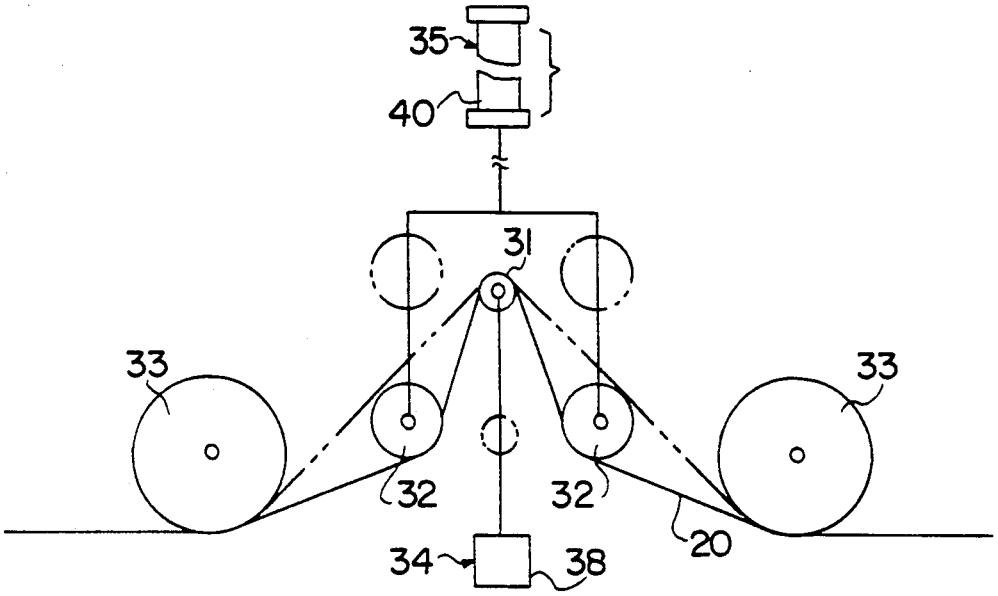
FIG. 2 is a schematic diagram of an embodiment of an apparatus for straightening sheet curls.
Figure 3:
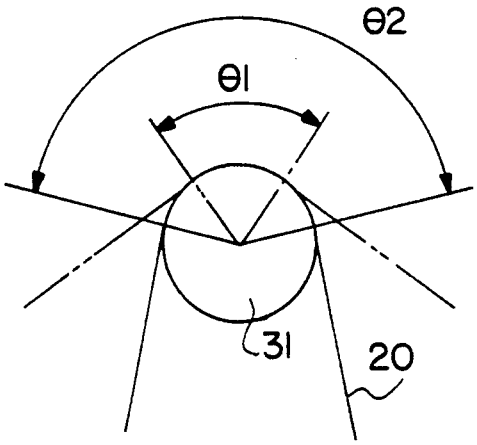
FIG. 3 is a schematic diagram which shows the change in wrap angle of a sheet.

Namely, the wrap angle adjusting device 34 controlled by the controller 16 causes (1) the decurler bar 31 to be displaced from the position (position shown by the two-dot chain lines in FIG. 2) corresponding to a large parent roll in correspondence with the change in diameter of each of the parent rolls 19 to the position (position shown by the solid lines in FIG. 2) corresponding to a small parent roll in the state wherein the main backup rolls 32 are set at the standard positions (positions shown by the solid lines in FIG. 2) at which the sheet is pushed inwardly. As a result, the wrap angle $\theta$ of the sheet 20 is adjusted between a small angle $\theta 1$ corresponding to the large parent roll and a large angle $\theta 2$ corresponding to the small parent roll (refer to FIG. 3). During this adjustment, the controller 16 performs the successive determination of the wrap angle $\theta$ (or the amount of displacement S of the decurler bar 31) which is optimum for straightening of curls using logical equation or figures incorrespondence with the change in diameter of each of the parent rolls 19. The controller 16 also controls the driving portion 37 in such a manner that an optimum wrap angle $\theta$ (or an optimum diaplacement S of the decurler bar 31) calculated as described above is achieved in correspondence with the change of the diameter D.

Data for the logical equation and the figure used for calculating an appropriate wrap angle $\theta$ for straightening curls in correspondence with the change in diameter D of the parent rolls are determined in advance for each type of sheet and each component item of the straightening apperatus, and stored in the data storage memory 100. Data appropriate to the relevant operation of straightening is supplied from the data storage memory to the controller 16.

The wrap angle adjusting device 34 which is controlled by the controller 16 operates to (2) return the decurler bar 31 to the position corresponding to the large parent roll from the small parent roll when the controller 16 controls the sheet splicing apparatus 12 in such a manner that the sheet from the first parent roll 19A is spliced to the sheet from the second parent roll 19B, as described above.

(b) The apparatus 35 for suddenly changing the wrap angle drives the main backup rolls 32 using, for example, a cylinder 40 which is operated by the driving portion 39 controlled by the controller 16.

In other words, the apparatus 35 for suddenly changing the wrap angle controlled by the controller 16 causes the main backup rolls 32 to retract from the standard positions at which the sheet is pushed inwardly to the position at which the sheet is not pushed inwardly (or moderately pushing inwardly) so as to suddenly change the wrap angle $\theta$ of the sheet 20 substantially at the same timing as the controller 16 controls the wrap angle adjusting device 34 to start the return of the decurler bar 31 from the position corresponding to the small parent roll to the position corresponding to the large parent roll.

(c) The secondary backup rolls 33 are stationarily provided on both outer sides of the decurler bar 31 and the main backup rolls 32, as described above, and serve to guide the sheet 20 in such a manner that the wrap angle $\theta$ of the sheet 20 is a value ($\theta 1$) suitable for the diameter of the first parent roll 19B having a large diameter, when the apparatus 35 for suddenly changing the wrap angle causes the main backup rolls 32 to retract from the positions at which the sheet is pushed inwardly.

A description will now be given of the function of the above-described embodiment.

Figure 4A:
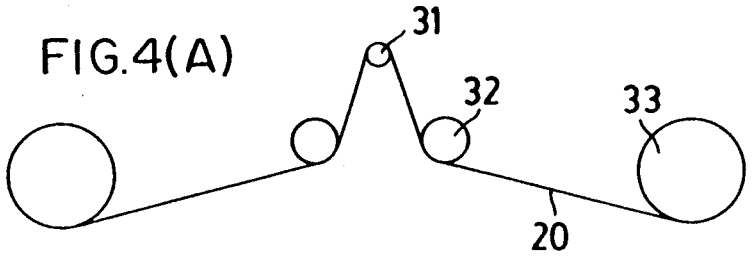
FIGS. 4*a–f* are a schematic diagram of the operation of an apparatus for straightening sheet curls.

The curl straightening apparatus 13 operates in the following manner:

(A) When the sheet is wound off from the identical parent roll 19, the wrap angle adjusting device 34 functions to displace the decurler bar 31 from the position corresponding to the large parent roll to the position corresponding to the small parent roll in correspondence with the change in diameter of the parent roll in the state wherein the main backup rolls 32 are set at the standard positions at which the sheet is pushed inwardly, so that the wrap angle $\theta$ of the sheet 20 is set to an appropriate value for the diameter D of the parent roll used, resulting in appropriate straightening of curls (see FIG. 4(A)).

(B) The sheets from the first and second parent rolls 19A, 19B are spliced to each other by the sheet splicing apparatus 12 in the following processes (1) to (4):

① The wrap angle adjusting device 34 starts the return of the decurler bar 31 from the position corresponding to the small parent roll to the position corresponding to the large parent roll.

Figure 4B:
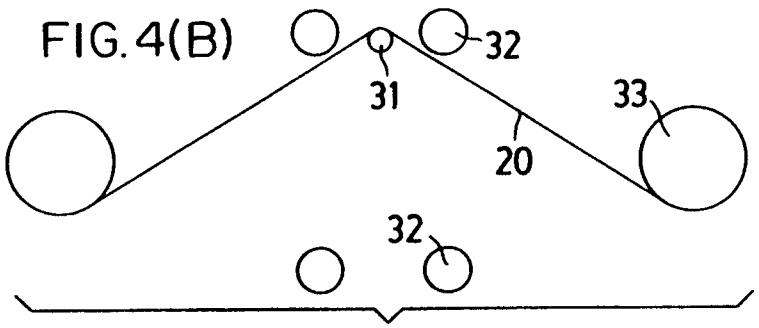

② The apparatus 35 for suddenly changing the wrap angle causes the main backup rolls 32 to retract from the standard positions at which the sheet is pushed inwardly to the position at which the sheet is not pushed in (or moderately pushed in) so as to suddenly change the wrap angle $\theta$ of the sheet 20 substantially at the same timing as the above-described process ① of starting the return. During this operation, the sheet 20 is guided by the secondary backup rolls 33, and the wrap angle $\theta$ of the sheet 20 is set to a value appropriate to the diameter of the second parent roll having a large diameter in a moment. As a result, the curls in the sheet 20 wound off from the second parent roll 19B having a large diameter are appropriately straightened (refer to FIG. 4(B)).

Since it is sufficient that the apparatus 35 for suddenly changing the wrap angle simply functions to selectively switch between two positions of the main backup rolls 32, i.e., the standard positions at which the sheet is pushed inwardly and the positions at which the main backup rolls are retracted, the operation of switching can be easily completed in an instant.

Figure 4C:
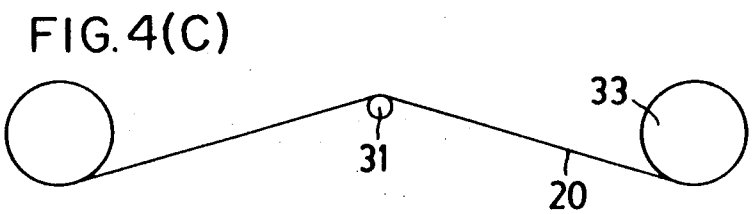

③ The decurler bar 31 is completely returned to the position corresponding to the large parent roll by the wrap angle adjusting device 34 (refer to FIG. 4(C)).

Figure 4D:
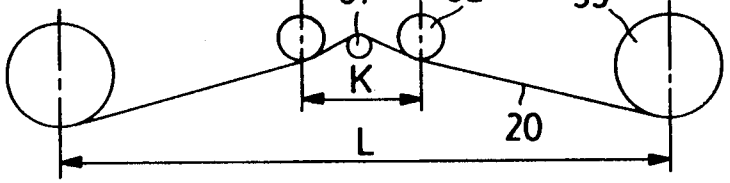

④ The main backup rolls 32 are reset to the standard positions at which the sheet is pushed inwardly from the positions at which the main backup rolls are retracted, by the apparatus 35 for suddenly changing the wrap angle (refer to FIG. 4(D)).

Figure 4E:
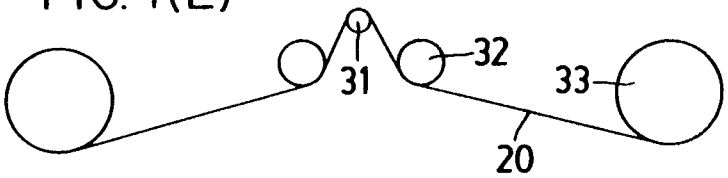
Figure 4F:
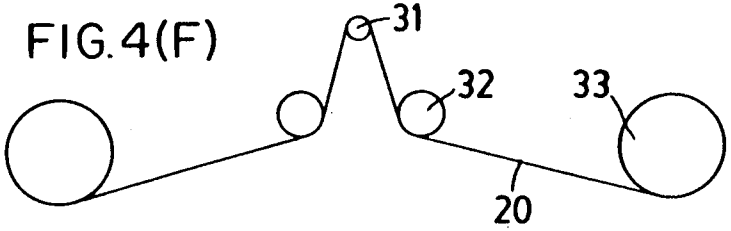

(C) The wrap angle adjusting device 34 functions to displace the decurler bar 31 from the position corresponding to the large parent roll to the position corresponding to the small parent roll in correspondence with the reduction in diameter D of the second parent roll 19B in the same manner as that described in (A). The wrap angle of the sheet is therefore set to a value optimum for the parent roll used, resulting in appropriate straightening of curls (refer to FIGS. 4(E) and 4(F)).

The above-described embodiment therefore enables the wrap angle of the sheet 20 to be changed in a moment in accordance with the changes in the diameter of the parent roll used in the state wherein the line speed of the sheet cutting and treating apparatus 10 is kept at a high value which is determined by, for example, the capacity of the cutting machine 15, when the first and second parent rolls are changed over as above described in (B). The curls in the sheet 20 can be appropriately and certainly straightened, while the productivity of the line being maintained.

In FIG. 4, (A) and (F) each represent the case where the diameter of the parent roll 19 used is minimum, the decurler bar 31 is placed at the position corresponding to the small raw parent roll, and the wrap angle $\theta$ of the sheet 20 is the maximum value $\theta$ 2. (C) represents the case where the diameter of the parent roll 19 used is maximum, the decurler bar 31 is placed at the position corresponding to the large parent roll, and the wrap angle $\theta$ of the sheet 20 is the minimum value $\theta$1.

In FIG. 4, although the wrap angle $\theta$ of the sheet 20 slightly changes as the state of the sheet 20 changes from (B) to (D), such a change in the wrap angle $\theta$ is reduced to be negligible for practical use if the distance K between the main backup rolls 32 is sufficiently smaller than the distance L between the secondary backup rolls 33.

Figure 5:
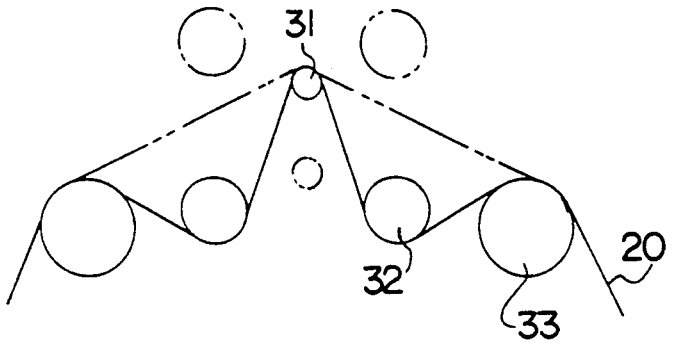
FIG. 5 is a schematic diagram of another embodiment of the apparatus for straightening sheet curls.

In an application of the present invention, any forms of handling of the sheet can be applied to the decurler bar, the main backup rolls and the secondary backup rolls. For example, as shown in FIG. 5, the sheet 20 may be handled on the upper side of the secondary backup rolls.

In an application of the present invention, the wrap angle adjusting device may adjust the wrap angle by controlling the displacement of the main backup rolls in accordance with the changes in the diameter of each winding roll in place of the control of the displacement of the decurler bar. In this case, the apparatus for suddenly changing the wrap angle switches in an instant the decurler bar between the standard position at which the sheet is pushed inwardly and the position at which the decurler bar is retracted.

In the present inventin, the wrap angle adjusting device may function to displace one of the main backup rolls and the decurler bar along a straight line relative to the other, as well as displacing it along a curve line by an operation of turning.

As described above, the present invention is capable of straightening curls in a sheet in a certainly and appropriate manner while maintaining the productivity of a line during the time a first parent roll is changed into a second parent roll.

What is claimed is:

1. An apparatus for straightening web curls which is provided in succession to a web splicing apparatus for splicing a portion at a rear end of a web supplied from a first parent roll to a portion at a front end of a web supplied from a second parent roll and in which a wrap angle is provided for a web wound off from each parent roll by applying a decurler bar between two main backup rolls to said web for the purpose of straightening curls in said web, said apparatus comprising a main backup rolls moving device for retracting and advancing said two main backup rolls against a web line; a decurler bar moving device for retracting and advancing said decurler bar against said web line; a wrap angle adjusting device for controlling said decurler bar moving device such that the wrap angle of said web is adjusted by displacing said decurler bar from a position corresponding to a large parent roll to a position corresponding to a small parent roll in correspondence with a change in diameter of said parent roll when said two main backup rolls is set to a standard position at which said web is pushed inwardly, and for returning said decurler bar to a position corresponding to said large parent roll from a position corresponding to said small parent roll when said webs respectively supplied from said first and second parent rolls are spliced to each other by said web splicing apparatus; a means for suddenly changing said wrap angle by controlling said main backup rolls moving device such that said two main backup rolls is retracted from said standard position at which said web is pushed inwardly to a position wherein said web is not pushed inwardly at a same time as a starting of a return of said decurler bar from a position corresponding to said small parent roll to a position corresponding to said large parent roll by said wrap angle adjusting device; and secondary backup rolls which are provided on both sides of said main backup rolls and which serve to guide said web such that said wrap angle of said web is a value appropriate to a diameter of said second parent roll having a large diameter when said two main backup rolls are retracted from said standard position by said apparatus for suddenly changing said wrap angle.

* * * * *